United States Patent [19]

Richards

[11] 4,020,384

[45] Apr. 26, 1977

[54] LINEAR PARTICLE ACCELERATOR

[75] Inventor: John A. Richards, S. Hamilton, Mass.

[73] Assignee: The Raymond Lee Organization, Inc., New York, N.Y. ; a part interest

[22] Filed: Aug. 25, 1975

[21] Appl. No.: 607,318

[52] U.S. Cl. ..... 313/359; 328/233

[51] Int. Cl.[2] ..... H05H 9/00; H01J 23/00; H01J 29/00

[58] Field of Search ..... 313/359–363; 328/233; 315/5.41, 5.42

[56] References Cited

UNITED STATES PATENTS

| | | | |
|---|---|---|---|
| 2,772,365 | 11/1956 | Shelman | 313/363 X |
| 2,818,507 | 12/1957 | Britten | 313/363 X |
| 3,253,402 | 5/1966 | Hammer | 60/202 |
| 3,265,918 | 8/1966 | Wittkower | 313/230 |
| 3,308,621 | 3/1967 | Pinsley | 313/359 X |
| 3,761,828 | 9/1973 | Pollard et al. | 328/227 |

*Primary Examiner*—R. V. Rolinec
*Assistant Examiner*—Vincent J. Sunderdick
*Attorney, Agent, or Firm*—Howard I. Podell

[57] ABSTRACT

A linear particle accelerator which provides a pulsed beam of charged particles of uniform energy. The accelerator is in the form of an evacuated dielectric tube, inside of which a particle source is located at one end of the tube, with a target or window located at the other end of the dielectric tube. Along the length of the tube are externally located pairs of metal plates, each insulated from each other in an insulated housing. Each of the plates of a pair are connected to an electrical source of voltage of opposed polarity, with the polarity of the voltage of the plates oriented so that the plate of a pair, nearer to the particle source, is of the opposed polarity to the charge of the particle emitted by the source. Thus, a first plate about the tube located nearest the particle source, attracts a particle which as it passes through the tube past the first plate is then repelled by the reverse polarity of the second plate of the pair to continue moving towards the target.

2 Claims, 2 Drawing Figures

LINEAR PARTICLE ACCELERATOR

SUMMARY OF THE INVENTION

My invention is a self-exited linear particle accelerator which provides a pulsed beam of charged particles. The accelerator is in the form of an evacuated dielectric tube, inside of which a particle source is located at one end of the tube, with a target or window located at the other end of the dielectric tube. Along the length of the tube are externally located pairs of metal plates, each insulated from each other in an insulated housing. Each of the plates of a pair are connected to an electrical source of voltage of opposed polarity and to each other through a system of conductors of computer lengths, with the polarity of the voltage of the plates oriented so that the plate of a pair, nearer to the particle source, is of the opposite polarity to the charge of the particle emitted by the source.

Thus, initially, the particles are accelerated by the electric field between the first two plate pairs, the first stage, and into the electric field between the second two plate pairs, the second stage, and similarly through the accelerator. This initial condition, however, will persist only momentarily when the machine is initially turned on due to interaction between the beam and the accelerator plates. As a result of this interaction, oscillations will be set up in the accelerator and the particle beam will form into packets of particles under the influence of a velocity selection effect.

In order for the machine to continue to operate effectively as an accelerator, it must oscillate in step with the beam. This is readily accomplished by adjusting the length of conductor between the plate pairs. Once the source voltage and the type of particle to be accelerated is decided upon, the transit time of a particle across any stage is calculated. Once this transit time (T) is found, the length of conductor connecting the plate pairs of that stage (as measured from the accelerator axis) is calculated by multiplying the velocity of light by (T); this conductor length can be multiplied by any whole number to arrive at a feasible suitable length.

The end plate pairs may be externally mounted although it is simpler to mount them flush with the dielectric tube ends. The source voltage is Direct Current.

While for purposes of simplicity single conductors are shown connecting the plates, it will be found in practice that depending upon the circumference of the plate pairs at least four symmetrically spaced conductors should be used to enhance the operation of the machine. It is of value to isolate the power supply from the accelerator by placing R.F. chokes one wave length out along the power feed lines from the accelerator.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
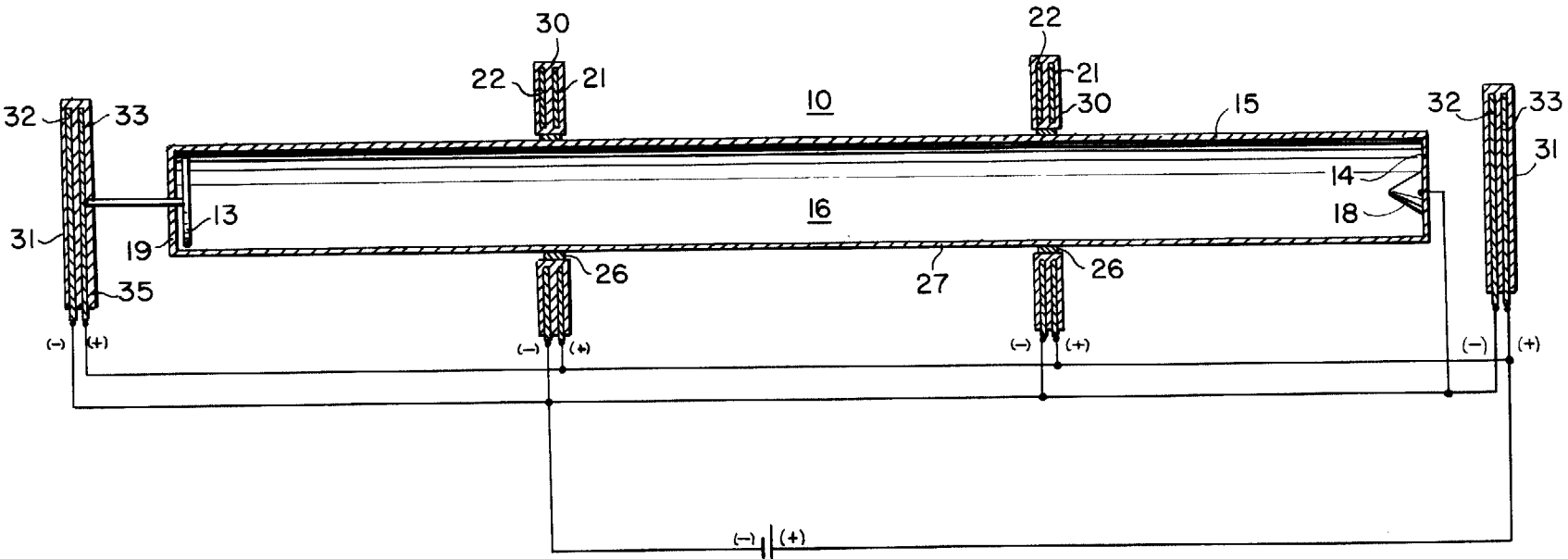
FIG. 1 is a sectional view of the invention.
Figure 2:
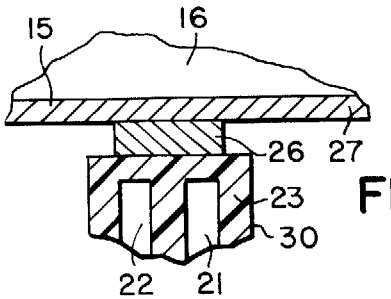
FIG. 2 is a fragmentary sectional view of the tube and circular plates.

Turning now descriptively to the drawings, in which similar reference characters denote similar elements throughout the several views, FIG. 1 illustrates the Linear Particle Accelerator 10 which is formed of a sealed dielectric tube 15, the interior 16 of which is evacuated to a high vacuum. A particle source 18 is located inside a first end 14 of the tube 15, and a target plate 13 is located externally or flush to the end of the tube 16.

One or more drive units 30 are mounted about the tube 15 between the target 13 and the particle source 18, with a drive unit 30 comprising a pair of pierced metal disks 21 and 22 mounted in a plane perpendicular to the axis of the tube 16 with each disk 21 and 22 surrounded by electrical insulation of insulator block 23. A metal ring 26 is mounted about the exterior wall 27 of the tube 15 between the tube wall 27 and the insulation block 23.

End drive 31 units are mounted externally or flush with each end 14 and 19 of the tube 15, with each end drive unit 31 comprised of a pair of metal disks 32 and 33 each insulated from the other and mounted in insulator block 35.

The operation of the accelerator 10 is described in terms of a direct current electrical source.

Particle Source 18 and plates 22 and 32 of the drive units are of negative polarity being joined by wires the negative pole of the voltage source 36 with target 13 and plates 21 and 33 of the drive units joined to the positive pole of voltage source 36.

Under these conditions, electrons which are emitted from particle source 18, are repelled from adjacent negatively charged end plate 32 and attracted by positively charged end plates 21 and 33 towards the positively charged target plate 13. As an electron passes through the plane of drive unit 30, metal band 26 isolates the charged plates 21 and 22 from directly affecting the electron motion, with the electron repelled by negatively charged plate 22 after it has passed the drive unit 30.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A linear particle accelerator which impells a stream of charged particles against a target comprising a sealed evacuated tube of dielectric material, a particle source mounted in a first end of the tube and a target mounted in the second end of the tube, and a drive unit mounted externally about said tube located between the tube ends, said drive unit consisting of a pair of pierced metal disks, each mounted back-to-back in a plane generally perpendicular to the axis of the tube, with both disks insulated from each other in a common insulated housing, in which the particle source and the target are connected to opposed polarities of an electrical voltage source, with the two disks of the drive unit each connected to opposed polarities of an electrical voltage source, with the disk of the drive unit that is located nearer the particle source connected to a voltage source of opposed polarity to that of the particle source, and with the other disk of the drive unit connected to a voltage source of similar polarity to that of the particle source.

2. The combination as recited in claim 1 in which a plurality of drive units, spaced from each other, are mounted about said tube.

* * * * *